US008519643B2

(12) United States Patent
Darras et al.

(10) Patent No.: US 8,519,643 B2
(45) Date of Patent: Aug. 27, 2013

(54) LIGHTING FIXTURE AND METHOD FOR OPERATING SAME

(76) Inventors: Gilles Darras, Cheureuse (FR); Pascal Maillach, Arcueil (FR)

( * ) Notice: Subject to any disclaimer, the term of this patent is extended or adjusted under 35 U.S.C. 154(b) by 1517 days.

(21) Appl. No.: 10/595,490

(22) PCT Filed: Oct. 19, 2004

(86) PCT No.: PCT/IB2004/003819
§ 371 (c)(1),
(2), (4) Date: May 15, 2006

(87) PCT Pub. No.: WO2005/046295
PCT Pub. Date: May 19, 2005

(65) Prior Publication Data

US 2007/0052368 A1 Mar. 8, 2007

(30) Foreign Application Priority Data

Oct. 21, 2003 (NO) ..... 20034700

(51) Int. Cl.
*H05B 41/00* (2006.01)

(52) U.S. Cl.
USPC ..... 315/326; 315/84.51; 315/108; 315/324; 315/360

(58) Field of Classification Search
USPC ..... 315/291, 246, 307, 312, 360, 84.51
See application file for complete search history.

(56) References Cited

U.S. PATENT DOCUMENTS

| | | | | |
|---|---|---|---|---|
| 4,358,716 | A | 11/1982 | Cordes et al. | |
| 4,375,608 | A * | 3/1983 | Kohler | 315/307 |
| 4,388,563 | A | 6/1983 | Hyltin et al. | |
| 4,415,839 | A * | 11/1983 | Lesea | 315/308 |
| 4,488,088 | A | 12/1984 | Paget et al. | |
| 5,034,661 | A * | 7/1991 | Sakurai et al. | 315/207 |
| 5,444,333 | A * | 8/1995 | Lau | 315/94 |
| 5,854,538 | A * | 12/1998 | Krummel | 315/105 |
| 5,914,569 | A * | 6/1999 | Bildgen | 315/209 R |
| 5,945,787 | A | 8/1999 | Gorille et al. | |
| 5,962,989 | A | 10/1999 | Baker et al. | |
| 6,011,362 | A * | 1/2000 | Moisin | 315/307 |
| 6,181,086 | B1 * | 1/2001 | Katyl et al. | 315/307 |
| 6,453,217 | B1 | 9/2002 | Takita | |
| 6,617,805 | B2 * | 9/2003 | Ribarich et al. | 315/247 |
| 6,720,740 | B2 * | 4/2004 | Toyama | 315/247 |
| 7,042,170 | B2 * | 5/2006 | Vakil et al. | 315/291 |
| 2002/0153852 | A1 | 10/2002 | Liao et al. | |

* cited by examiner

*Primary Examiner* — Douglas W Owens
*Assistant Examiner* — Jianzi Chen
(74) *Attorney, Agent, or Firm* — David A. Guerra

(57) ABSTRACT

A ballast for fluorescent tubes and the use thereof for producing fluorescent tube lighting fixtures using a novel gas excitation mode in which light is generated by means of controlled pulses leading to an increased power efficiency, with a data collection and transmission functionality, are disclosed.

16 Claims, 3 Drawing Sheets

LIGHTING FIXTURE AND METHOD FOR OPERATING SAME

CROSS-REFERENCE TO RELATED APPLICATION

This application is an U.S. national phase application under 35 U.S.C. §371 based upon co-pending International Application No. PCT/IB2004/003819 filed on Oct. 19, 2004. Additionally, this U.S. national phase application claims the benefit of priority of co-pending International Application No. PCT/IB2004/003819 filed on Oct. 19, 2004, and Norway Application No. 20034700 filed on Oct. 21, 2003. The entire disclosures of the prior applications are incorporated herein by reference. The international application was published on May 19, 2005 under Publication No. WO 2005/046295.

BACKGROUND OF THE INVENTION

1. Field of the Invention

This invention relates in general to fluorescent lighting luminaries and more particularly to a new operating mode of fluorescent tubes in a luminary.

2. Description of the Prior Art

A fluorescent tube is a discharge glass bulb whose inner side is covered with fluorescent layer that reacts by emitting visible light when excited by ultraviolet radiation sourced from the gas medium that fills the bulb. Such a gas contains very low pressure mercury vapor.

FIG. 1 is a diagram describing the principle of construction and operation of a single fluorescent tube luminary. A flux of electrons 4, crossing the tube 14 between the two electrodes 16 placed at each end, excites mercury atoms 3 and produces ultraviolet radiation 5. These electrodes consist of electron thermo-emissive filaments (called pre heating Cathodes) that must heat to incandescent. The alternative main current voltage is used to supply power to the cathodes through a high inductive coil (called Ballast) included to the circuit, that limits the current drawn by the low impedance ionized gas to an acceptable value.

Igniting the conduction through the gas requires a special device (called Starter) connecting the heating filaments directly one to the other, in parallel with the gas medium (see FIG. 1, low section). The starter may consist of a filament bulb including a switch reacting to temperature opened at normal temperature. When the power is applied to the circuit, the current starter bulb lights on and internal temperature goes up rapidly while the cathodes of the fluorescent tube are incandescent. When the temperature is high enough, the switch closes, short cutting the starter which rapidly decreases in temperature and thus opens again the switch. This sudden interruption causes the current to induce a high voltage surge at the coil's outputs (self induction effect) thereby producing an igniting conduction between the two cathodes, through the mercury vapor heated by the incandescent filaments. From this point, the starter is not activated as long as the conduction of the vapor remains. The filaments of the cathodes stay incandescent due to their construction and position that drive a part of the current crossing the tube to flow through their surface also hit by mercury ions that help to maintain temperature by dissipating collision energy.

As conduction is ignited and current stabilizes, the tube's impedance decreases significantly. Due to its value of impedance at operating frequency of the main power, the ballast coil ensures proper current limitation. Such a system is defined as "magneto-inductive ballast".

However, some evolutions exist in ballast technology that improve the simple description above, and stated in FIG. 1.

Generally, a ballast is serial impedance that stabilizes the current in the fluorescent tube, usually, as mentioned above, simple inductors are used as ballasts because they operate as reactances with small losses when serial coupled to the tube. Some magnetic ballasts provide more features than serial impedance for the tube like for instance transformers for increasing voltage levels.

In the goal of energy saving, other types of ballast have been developed applying solutions that use semiconductors. This more sophisticated design brought also possibilities to use operating frequencies higher than conventional 50/60 Hz from main electric supply. Frequency in the range of 25 kHz has been employed. Examples of electronic Ballast design are described in patents WO 00/21342 published April 2000, WO 99/05889 published February 1999, WO 97/33454 published September 1997, WO 99/60825 published November 1999, WO 98/34438 published August 1998 and EP-O-955794-A2 published November 1999. Exposed solutions relate mainly to current savings and life time improvement of fluorescent tubes by optimizing different parameters such as waveform, voltage amplitude . . . etc.

U.S. Pat. No. 6,262,542 discloses an electronic Ballast including a lamp driving circuit having a pulse width modulated signal generator to control the duty cycle of the square wave form current flowing through the lamp. The '542 patent further describes a control signal that is included into the circuitry for monitoring the lamp operation. It is also to note that lamp coupling method as described in U.S. Pat. No. 6,262,542 forces the current to flow through the cathode's filaments.

U.S. Pat. No. 4,902,939 discloses a driving circuitry dedicated to avoid light flickering when witching on and off the power from minimum to maximum variable lighting intensity. Obviously the objective is not to increase the power efficiency of fluorescent lamps. The major difference with the invention is that the driving voltage described in U.S. Pat. No. 4,902,939 consists of sinusoidal waveforms directly derived from main power supply.

Although existing electronic ballasts intend to bring energy savings through their operating modes of fluorescent tubes as well as to extend life time of fluorescent lamps, considerable research and development remain to be done in this domain. The invention discloses a particular brand new operating mode for fluorescent tubes that reduces current drawn by the lamp for 40% to 50% regarding to conventional magnetic ballasts mostly installed in fluorescent lighting fixtures.

In addition, life time of tubes driven by the invention increases for up to 3 times and light emitted does not flicker or suffer stroboscopic effect.

Above benefits are obtained by operating fluorescent luminaries in a way disclosed in the present invention. Such luminaries include one or more standard fluorescent tubes that contain mercury vapor gas and heating filament cathodes at both ends, a fixture that integers proper holding and connection devices for the fluorescent tubes, and one ballast for driving the fluorescent tubes. Ballast operating mode differs from existing systems by the fact that it uses voltage pulses applied to the electrodes for exciting the fluorescent gas, such pulses consisting of non periodic voltage levels separated by variable duration dead times.

SUMMARY OF THE INVENTION

In a preferred implementation, the ballast generates pulses composed of perfectly alternate voltage amplitudes. The ballast is also able to control the timing of pulses as well as the dead times by using programmed algorithms. Another benefit can result in monitoring dead times between pulses from real time samplings of the current in the tube. Special coupling installed in tube's connections are controlled by the ballast to short cut cathode's filaments on right time, in order to cancel any current flow through it and so avoid losses of voltage. Ignition of conduction in the tube can profit of temporarily connecting a capacitor that seriously increases voltage at ends of every fluorescent tube and is disconnected as soon as the conduction establishes. The ballast modifies the current in the tube after the conduction happens in order to reduce the current in the capacitor to the minimum before disconnecting it.

In a preferred implementation, the ballast can communicate with a control unit through a wired or wireless link for performance monitoring and remote failure detection.

In another aspect, the invention also relates to luminaries that fit in with multiple standard fluorescent tubes containing mercury vapor gas and heating cathodes located at both ends, and consisting of a fixture including tube connection/holding devices and a ballast for operating fluorescent tubes.

The luminary according to the invention differs from existing systems by the fact that it uses voltage pulses applied to the electrodes for exciting the fluorescent gas, such pulses consisting of non periodic voltage levels separated by variable duration dead times.

In a particularly preferred implementation form of the invention, the ballast can be advantageously adapted to generate pulses composed of alternate voltage amplitude. The ballast is also able to control the timing of pulses as well as the dead times by using programmed algorithms. In an even more preferred implementation form, the ballast is adapted to monitor dead time between pulses from real time samplings of the current that crosses gas in the fluorescent tubes. Fluorescent tube's connectors include special couplings that can be activated by the ballast to short cut the cathode's filaments on right time, in order to cancel any current flow through it and so avoid losses of voltage. A capacitor can be connected to increase the voltage at ends of every fluorescent tube allowing to ignite the conduction through the gas, and can be disconnected as soon as the conduction establishes. In this case, the ballast can be adapted further to modify the current in the tube after the conduction happens in order to reduce the current in the capacitor to the minimum before disconnecting it.

It is particularly appropriate when many luminaries are used in a single place that the ballasts have an on line or wireless link with a central control unit, for performance monitoring and remote failure detection.

In some implementation, the ballast includes two parts, the first being a standard ballast operating at normal main power supply voltage, and the second being specifically designed to operate with the non periodic pulses as described in the invention.

The invention is also presented under a third form, namely as a voltage supply signal for the fluorescent tubes in normal operating condition, with the signal being formed of pulses characterized by including non periodic voltage levels separated by variable length dead times. Preferably, the signal pulses are of alternative nature i.e. the signal includes equal amplitudes of positive and negative polarity.

BRIEF DESCRIPTION OF THE DRAWINGS

The invention will be developed more in detail below, by means of examples of implementation form, and it will refers to the diagrams attached, where.

DESCRIPTION OF THE INVENTION

Figure 1:
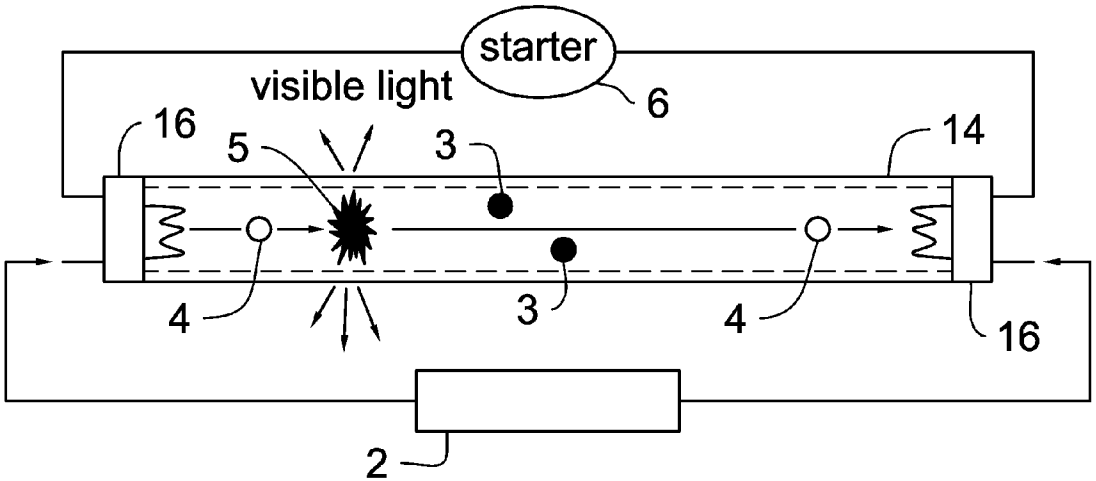
(Prior Art) FIG. 1
FIG. 1 represents a simplified traditional diagram of a fluorescent tube with a magneto-inductive ballast and a starter.

FIG. 1 in appendix represents the simplest shape of a magneto-inductive type ballast 2 in series with a fluorescent tube 14, in which the electric main voltage supplies the tube 1 with a frequency of 50 or 60 Hz. This kind of ballast, with possibly some minor evolutions, are mostly used in today luminaries. Although some manufacturers are seeking to market new electronic ballasts because luminaries equipped with such electronic ballasts have higher costs that significantly restrain a broad diffusion of these technologies.

The present invention characterizes a new kind of electronic ballast different from existing systems by the fact that it is intended to replace the conventional magnetic ballast in existing luminaries without need of removing the original magnetic ballast when installing the ballast from the invention.

Figure 2:
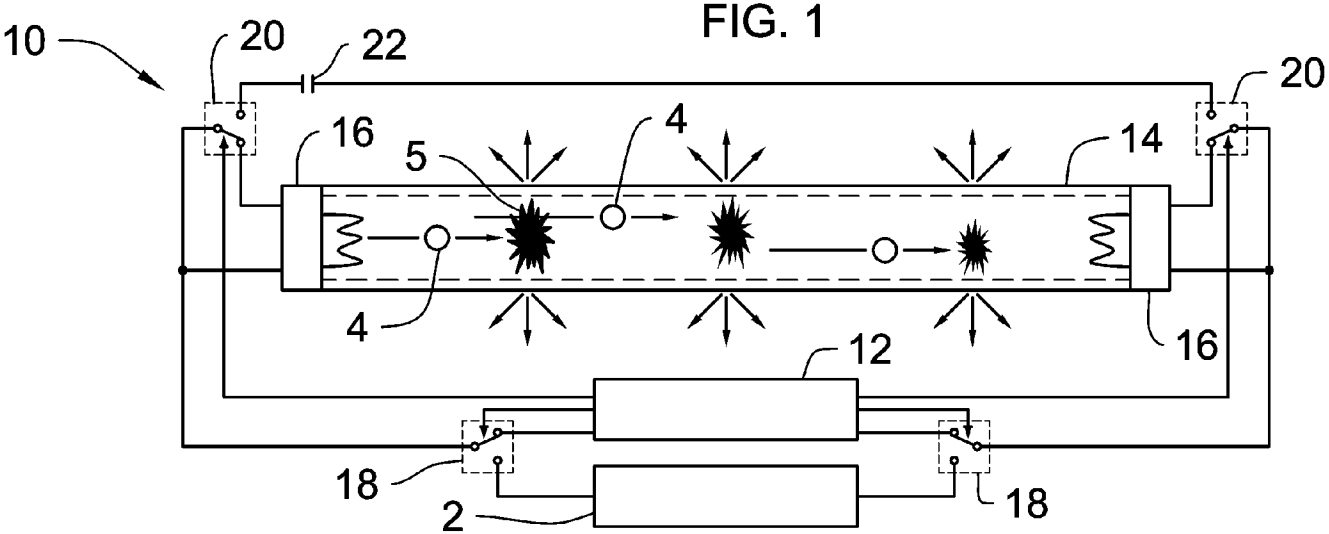
FIG. 2 represents a comparison between a conventional magneto-inductive ballast and the new ballast according to the present invention.

FIG. 2 schematically represents the action of the new ballast 12 designed with the invention 10. The operation of a fluorescent tube 14 equipped with conventional magnetic ballast 2 is illustrated in FIG. 1. FIG. 1 shows the excitation of mercury atoms 3 by the collision of an electron 4 flowing between the pre-heating electrodes 16 occurs randomly and relatively seldom (cf the only collision represented inducing light radiation).

FIG. 2 represents the action of the new ballast 12 working with voltage levels of a very different nature. The latter induces much more collisions and consequently excites more mercury atoms. This phenomenon is illustrated on FIG. 2 by three collisions leading to higher ultraviolet radiation 5. The efficiency increases from the standard level of 65 lumens per unit of power (Watt) for the conventional magnetic ballast 2 to a value of 120 lumens per Watt by using the new ballast 12 from the invention.

The main point concerning the impact of the new ballast 12 on the lighting efficiency is that the ignition voltage applied to a fluorescent tube 14, i.e. from one electrode 4 to the other, is a high frequency alternative voltage consisting in non periodic pulses separated by variable duration dead times. This special voltage waveform is generated so that every dead time (time of no voltage) is monitored from real time samplings of the current flow crossing the tube 14. The current intensity depends on a resonance effect in the gas that significantly increases the number of collisions between electrons and mercury atoms. By using this resonance phenomenon, the power consumption can be considerably reduced. The high frequency voltage is used to be just sufficient to maintain the resonance and the voltage level is void as long as the resonance phenomenon maintains the light emission. The current measurement reveals instantaneously the resonance effect, allowing the microprocessor included in the ballast to monitor the voltage waveform in real time.

The voltage pulses are preferably of completely alternative form, i.e. using voltages of same amplitudes and opposite polarity, and are non periodic events. The waveform is real time controlled through programmed algorithms, embedded in the ballast's microprocessor.

These algorithms refer preferably to measurements of the current crossing the plasma in the tube for controlling particularly the dead time duration between pulses according to the value of the current level. The current is continuous real time sampling.

Figure 3:
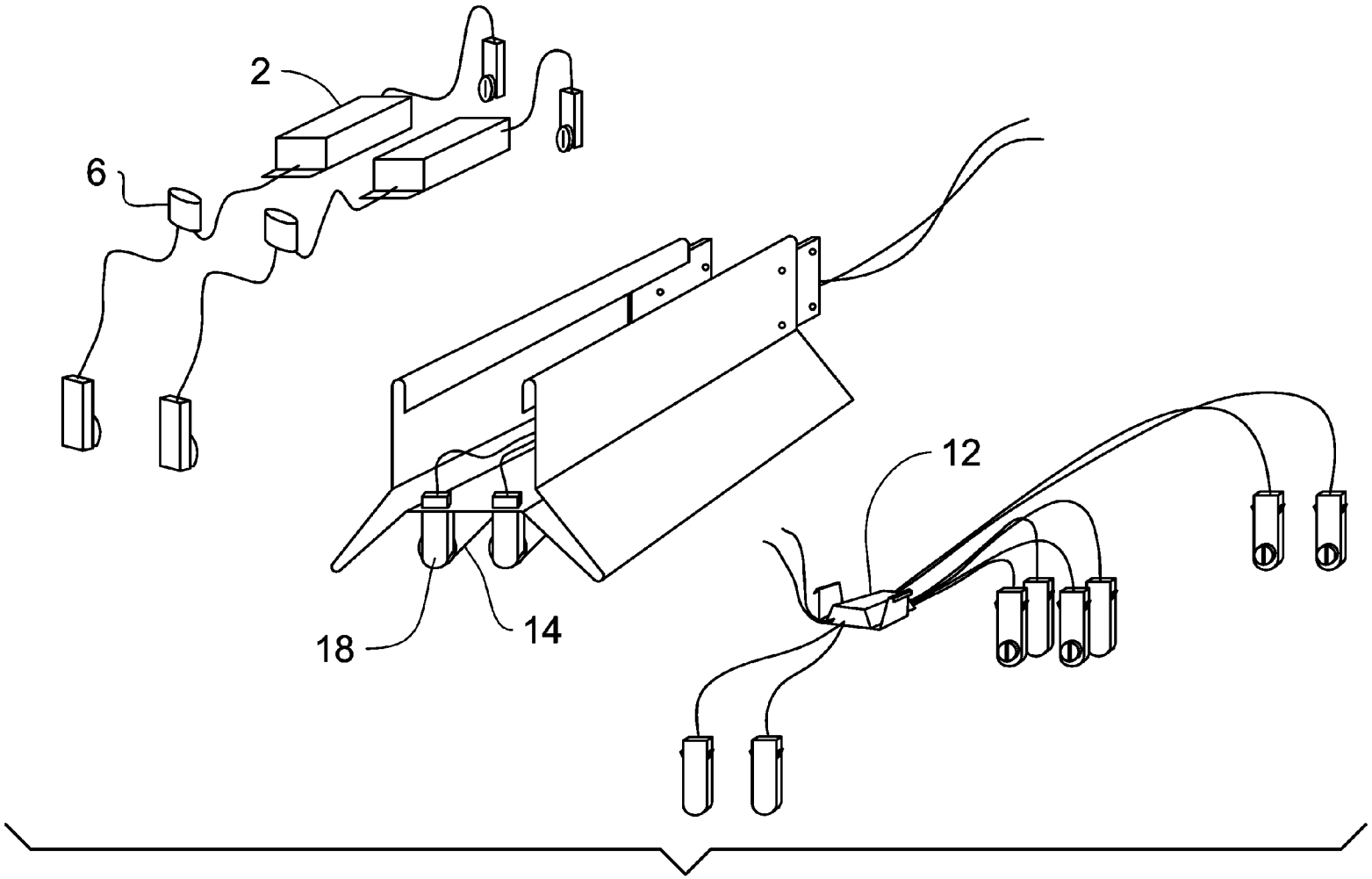
FIG. 3 shows schematically how the new ballast according to the present invention is installed in an existing luminary.

As appearing in FIG. 3, an existing luminary is equipped with a new kit of components, especially designed to fit the luminary. This new kit includes in addition to the electronic ballast from the invention, new tube connectors 18 that are inserted in place of the original plugs. The old components are left in place (i.e. magnetic ballast 2 and starter 6) and the new ballast 12 is connected to the main power supply bus by using quick coupling devices.

The new connectors 18 include preferably special coupling devices 20, wherein the new ballast can be activated to short cut the filaments of the cathodes in order to void any current flow through them and thus cancel losses of voltage.

To ignite conduction in the fluorescent tube 14, a capacitor 22 is briefly connected in parallel with the tube 14 in order to increase the voltage between the electrodes 16. As soon as conduction is produced through the mercury vapor, the capacitor 22 is disconnected. The ballast 12 adapts the current through the mercury vapor once conduction occurs, in a way that current crossing the capacitor 22 is reduced to the minimum before removing the capacitor 22.

The new operating mode of fluorescent tube as described is based on the principle aiming to increasing the number of collisions between electrons and mercury atoms in molecular excitation of plasma medium where a new voltage waveform improves the lighting energy efficiency. The high frequency alternate signal that is used comprises accurate monitored dead time phases that contribute to reduce energy consumption to the minimum.

The process is optimized by constant monitoring of the current flowing through the tube and continuous regulation of the dead time, according to the programmed functions that supervise the conditions and physical parameters coupling voltage variations and collision rate between electrons and mercury atoms.

The program is included in an electronic device placed in the new ballast that is installed in luminaries. This electronic device looks like a "macrochip" electronic component including all processes of controlling and monitoring functions. The electronic device consists of a controller (central processing unit) which integrates the software in a secured and protected chip also containing coded functions which make it available only under precise conditions, in order to avoid any undesired access to the operation and program.

It should be noted that frequencies and voltage waveforms are in a much higher range of frequency than the main supply. In addition, it should be underlined that the variations of voltage are non sinusoidal and not periodic. The voltage variation includes dead time phases in which current in the tube is void. Because of this particular operating mode, it is not necessary that some current crosses the filaments of electrodes for maintaining the flow of electrons in the tube.

Because of appearance of a resonance phenomenon increasing the number of collisions between electrons generated by cathodes and mercury atoms in the gas, the operating mode according to the invention as stated above, reduces the operating temperature and improves electronic ballast reliability.

Optimal operation is reached thanks to controlled preheating of cathodes and specific excitation mode during ignition of conduction of the vapor whatever the temperature in the tube. The nominal running mode is thus reached gradually, as the resonance phenomenon maintained by the process stabilizes. During this phase of progressive transformation which requires a few minutes, the current crossing the tube increases, as well as the emission of light, by successive steps. At the end of this phase, the phenomenon of resonance is stable according to the specific environmental conditions. Current decreases gradually and reaches a minimum average value after approximately 15 minutes.

Thanks to the use of the procedure according to the invention, the temperature of the electrodes can be lowered by more than 40° C., which has a significant incidence over the lifespan of the tube.

Figure 4:
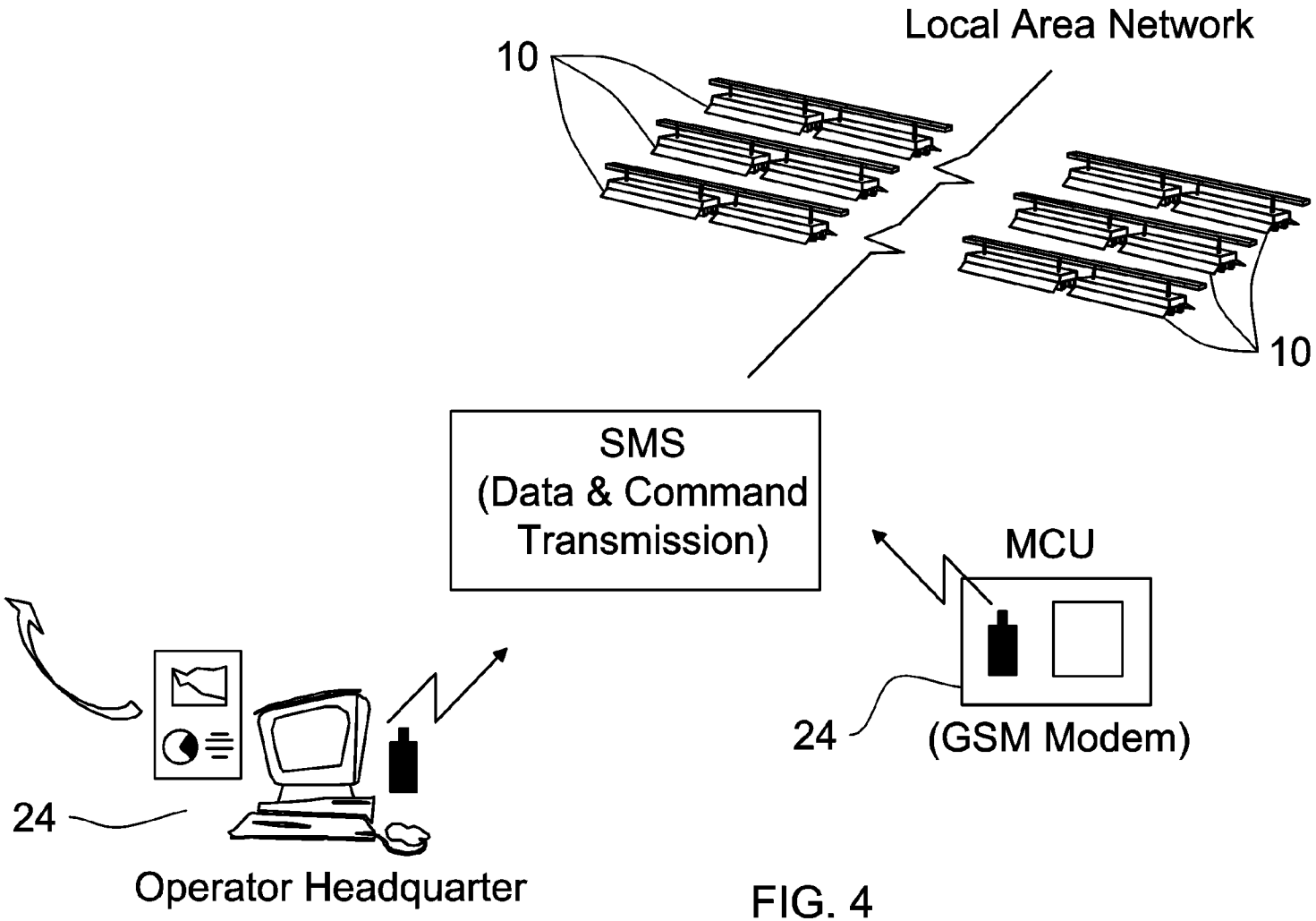
FIG. 4 shows schematically how a set of luminaries can interconnect in a network for remote monitoring.

FIG. 4 shows how a greater number of luminaries 10, each of them integrating the new ballast, is connected via a special communication bus to a central control unit 24. This unit can be local or remote, as shown on FIG. 4. In this example, a wireless connection in the form of SMS messages using GSM is used. In this type of control unit, the performance of the lighting system of a site can be recorded and the operation be permanently and remotely monitored in case of a breakdown. This makes it possible to provide to the users statistics and reports of precise operations statistics and reports stating amongst other things the energy consumption while making it possible to intervene more quickly when maintenance is necessary.

The invention claimed is:

1. A method of operating luminaries, said method comprising the steps of:

providing one or more fluorescent tubes that contain mercury vapor gas and at least one electrode located at ends of the fluorescent tubes, a fixture that comprises holding and connection devices for the fluorescent tubes, and a ballast for driving the fluorescent tubes, each of the electrodes includes a heating filament cathode;

applying voltage pulses to the electrodes for exciting the mercury vapor gas, the pulses consisting of non-periodic voltage levels separated by variable duration dead times being of alternative form including amplitudes of equal values but of positive and negative polarity;

maintaining the dead times of the pulses as long as a resonance effect in the mercury vapor gas maintains light emission, wherein the resonance effect is determined from real time samplings of a current flow crossing the one or more fluorescent tubes;

producing alternative voltage pulses from the ballast; and using the ballast to activate couplings of connection/fixation on each end of the fluorescent tubes, the couplings being configured to short cut the filaments of the electrodes of the fluorescent tubes respectively, to cancel the current through the electrodes, and to thus avoid the losses in voltage.

2. The method according to claim 1 further comprising the step of using a programmed algorithm of the ballast to monitor the voltage signals and the dead times.

3. The method according to claim 1, wherein the ballast monitors each dead times duration according to real time samplings of current crossing the mercury vapor gas in the fluorescent tubes.

4. The method according to claim 1 further comprising the step of igniting conduction through the mercury vapor gas of the fluorescent tubes by the temporary connection of a capacitor making it possible to increase tension between the electrodes of each fluorescent tube, and to disconnect the capacitor as soon as conduction is obtained.

5. The method to according to claim 4 further comprising the step of using the ballast to modify a current level that is crossing the mercury vapor gas, so current crossing the capacitor is minimized before the disconnection of the capacitor.

6. The method according to claim 1 further comprising the step of communicating the ballast with a remote central control unit through at least one of a wired link and a wireless link for performance monitoring and remote failure detection.

7. A luminary for fluorescent tubes, the luminary comprising:

one or more fluorescent tubes that contain mercury vapor gas and at least one electrode located at ends of the fluorescent tubes, each of the electrodes includes heating filament cathodes;

a fixture at each end of the tube fluorescent tubes that comprises holding and connection devices for the fluorescent tubes, each of the fixtures being configured to short cut the filament cathodes of the electrodes of the fluorescent tubes respectively, to cancel current through the electrodes, and to thus avoid the losses in voltage; and a ballast for driving the fluorescent tubes, the ballast being configured to generate voltage pulses applied to the electrodes for exciting the mercury vapor gas, the pulses consisting of non-periodic voltage levels separated by variable duration dead times being of alternative form including amplitudes of equal values but of positive and negative polarity;

wherein the dead times are maintained as long as a resonance effect in the mercury vapor gas maintains light emission, wherein the resonance effect is determined from real time samplings of the current crossing the one or more fluorescent tubes.

8. The luminary according to claim 7, characterized in that the ballast produces the voltage pulses and the dead times by means of programmed algorithms.

9. The luminary according to claim 7, characterized in that the ballast is configured to monitor each dead time duration according to real time samplings of current through the mercury vapor gas in the fluorescent tubes.

10. The luminary according to claim 7 further comprising a capacitor connected between the fixtures at each end of the tube fluorescent tubes to increase the voltage between the electrodes of each fluorescent tube in order to start conduction through the mercury vapor gas, the capacitor being disconnected as soon as conduction is obtained.

11. The luminary according to the claim 10, characterized in that the ballast is configured to modify the current crossing the mercury vapor gas when conduction is obtained, so that current in the capacitor is reduced to a lowest level of the capacitor before the disconnection of the capacitor.

12. The luminary according to claim 7, characterized in that the ballast includes at least one of a wire and a wireless connection enabling the ballast to communicate with a remote control unit for performance monitoring and remote failure detection.

13. The luminary according to claim 7, characterized in that the ballast includes at least two parts;

a first part being a standard ballast functioning with a main sector; and a second part being a specifically assembled part to work with the non-periodic pulses of the ballast.

14. A method of operating a fluorescent tube for reducing an operating temperature the fluorescent tube and improving electronic ballast reliability, said method comprising the steps of:

providing at least one fluorescent tube containing a mercury vapor gas, at least one electrode including at least one heating filament cathode located at each end of the fluorescent tube, a fixture that comprises holding and connection devices for the fluorescent tube at each end, and a ballast for driving the fluorescent tube;

producing non periodic voltage pulses from the ballast;

applying the non-periodic voltage pulses to the electrodes for exciting the mercury vapor gas, the non-periodic pulses are separated by variable duration dead times being of alternative form including amplitudes of equal values but of positive and negative polarity;

igniting conduction through the mercury vapor gas of the fluorescent tube by the temporary connection of a capacitor in parallel with the fluorescent tube making it possible to increase tension between the electrodes of the fluorescent tube;

disconnecting the capacitor when conduction is obtained;

controlling a pre-heating of the cathodes of the electrodes until a predetermined optimal operation is reached due to a controlled and specific excitation during the igniting conduction through the mercury vapor gas indifferent to temperature in the fluorescent tube;

monitoring current flowing through the fluorescent tube for determining a resonance effect, thereby allowing the ballast to monitor a voltage waveform of the fluorescent tube in real time;

regulating the dead time according to at least one programmed function that supervises the conditions and physical parameters coupling voltage variations and collision rate between electrons and mercury atoms;

allowing the igniting conduction to continue until a predetermined nominal running mode is reached;

allowing the current crossing the fluorescent tube and emission of light from the fluorescent tube to increase by successive steps;

allowing the current to decrease until a phenomenon of resonance is stable according to environmental conditions, the phenomenon of resonance being a resonance effect in the mercury vapor gas that increases a number of collisions between the electrons and the mercury atoms; and increasing the number of collisions between electrons and mercury atoms by depending current intensity on the resonance effect in the mercury vapor gas.

15. The method according to claim 14, wherein each fixture is configured to short cut the filament cathodes of the electrodes of the fluorescent tube, to cancel current through the electrodes, and to thus avoid losses in voltage.

16. The method according to claim 14 further comprising the steps of:

inserting the fixture in place of an original fluorescent tube connector respectively; and connecting the ballast to a main power supply bus, while leaving in place an original ballast and starter.

* * * * *